US011993835B2

(12) United States Patent
Takeda et al.

(10) Patent No.: US 11,993,835 B2
(45) Date of Patent: May 28, 2024

(54) GRAIN-ORIENTED ELECTRICAL STEEL SHEET AND METHOD FOR MANUFACTURING SAME

(71) Applicant: NIPPON STEEL CORPORATION, Tokyo (JP)

(72) Inventors: Kazutoshi Takeda, Tokyo (JP); Ichiro Tanaka, Tokyo (JP); Takashi Kataoka, Tokyo (JP); Tomoya Suenaga, Tokyo (JP); Yuki Kunita, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 531 days.

(21) Appl. No.: 17/421,769

(22) PCT Filed: Jan. 16, 2020

(86) PCT No.: PCT/JP2020/001191
§ 371 (c)(1),
(2) Date: Jul. 9, 2021

(87) PCT Pub. No.: WO2020/149345
PCT Pub. Date: Jul. 23, 2020

(65) Prior Publication Data

US 2022/0090239 A1 Mar. 24, 2022

(30) Foreign Application Priority Data

Jan. 16, 2019 (JP) ..... 2019-005238

(51) Int. Cl.

| | |
|---|---|
| ***C21D 8/02*** | (2006.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |

(52) U.S. Cl.
CPC ..... *C22C 38/06* (2013.01); *C21D 8/0205* (2013.01); *C21D 8/0226* (2013.01); *C21D 8/0236* (2013.01); *C21D 8/0284* (2013.01); *C21D 8/0289* (2013.01); *C21D 9/46* (2013.01); *C22C 38/001* (2013.01); *C22C 38/002* (2013.01); *C22C 38/02* (2013.01); *C22C 38/04* (2013.01)

(58) Field of Classification Search
CPC .. C21D 8/0236; C21D 8/0226; C21D 8/0289; C21D 8/0284
See application file for complete search history.

(56) References Cited

U.S. PATENT DOCUMENTS

| | | | |
|---|---|---|---|
| 3,856,568 A | 12/1974 | Tanaka et al. | |
| 3,932,236 A | 1/1976 | Wada et al. | |
| 6,287,703 B1 | 9/2001 | Inokuti | |
| 2020/0056256 A1* | 2/2020 | Takajo | C23C 28/042 |

FOREIGN PATENT DOCUMENTS

| | | |
|---|---|---|
| JP | 48-39338 A | 6/1973 |
| JP | 49-96920 A | 9/1974 |
| JP | 58-26405 B2 | 6/1983 |
| JP | 7-54155 A | 2/1995 |
| JP | 4041289 B2 | 1/2008 |
| JP | 4300604 B2 | 7/2009 |
| JP | 2018-62682 A | 4/2018 |

* cited by examiner

*Primary Examiner* — Jessee R Roe
(74) *Attorney, Agent, or Firm* — Birch, Stewart, Kolasch & Birch, LLP

(57) ABSTRACT

A grain-oriented electrical steel sheet is a grain-oriented electrical steel sheet which does not have an inorganic coating containing forsterite as a main component and which includes: a base steel sheet containing a prescribed chemical component; a silicon-containing oxide layer provided on the base steel sheet; an iron-based oxide layer provided on the silicon-containing oxide layer; and a tension-insulation coating provided on the iron-based oxide layer, having a thickness of 1 to 3 μm, and containing phosphate and colloidal silica as main components. When the tension-insulation coating undergoes elemental analysis using a glow discharge optical emission spectrometry in a sheet thickness direction from a surface of the tension-insulation coating, a peak Si emission intensity satisfies a prescribed requirement.

9 Claims, 3 Drawing Sheets

GRAIN-ORIENTED ELECTRICAL STEEL SHEET AND METHOD FOR MANUFACTURING SAME

TECHNICAL FIELD

The present invention relates to a grain-oriented electrical steel sheet and a method for manufacturing the same.

Priority is claimed on Japanese Patent Application No. 2019-5238, filed Jan. 16, 2019, the content of which is incorporated herein by reference.

BACKGROUND ART

Generally, grain-oriented electrical steel sheets are utilized as iron cores for transformers or the like and the magnetic characteristics of the grain-oriented electrical steel sheets have a significant influence on the performance of transformers. Thus, various research and development has been conducted to improve the magnetic characteristics. As a means for reducing the iron loss of grain-oriented electrical steel sheets, for example, Patent Document 1 below describes a technique for forming a tension application coating by applying a solution containing colloidal silica and phosphate as main components to a surface of steel sheet which has been subjected to final annealing and firing these to reduce the iron loss. Furthermore, Patent Document 2 below describes a technique for irradiating a surface of a material which has been subjected to final annealing with a laser beam to apply local strain to a steel sheet to subdivide magnetic domains and reduce iron loss. With these techniques, the iron loss of grain-oriented electrical steel sheets has become extremely good.

Incidentally, in recent years, there has been an increasing demand for reducing the size and increasing the performance of transformers. In addition, in order to reduce the size of transformers, grain-oriented electrical steel sheets are required to be excellent in terms of having a high magnetic field iron loss so that excellent iron loss is provided even when a high magnetic flux density is provided. As a means for improving this high magnetic field iron loss, research regarding eliminating an inorganic coating existing on an ordinary grain-oriented electrical steel sheet to apply more tension has been conducted. Since the tension application coating is formed later, the inorganic coating may be referred to as a "primary coating" and a tension application coating may be referred to as a "secondary coating" in some cases.

Inorganic coatings containing forsterite ($Mg_2SiO_4$) as a main component are generated on surfaces of grain-oriented electrical steel sheets by causing oxide layers containing silica ($SiO_2$) generated using a decarburization annealing process as a main component and magnesium oxides applied to a surface to prevent firing to react during final annealing. Inorganic coatings have a slight tension effect and have the effect of improving the iron loss of grain-oriented electrical steel sheets. However, as a result of the research so far, it has become clear since the inorganic coatings are non-magnetic layers, they adversely affect the magnetic characteristics (particularly, high magnetic field iron loss characteristics). Therefore, research regarding techniques for manufacturing grain-oriented electrical steel sheets in which inorganic coatings are not provided or techniques for making the surfaces of steel sheets have mirror surfaces (techniques for magnetically smoothing surfaces of steel sheets) by removing the inorganic coatings using mechanical means such as polishing or chemical means such as pickling or preventing the formation of inorganic coatings during high-temperature final annealing is being conducted.

As techniques for preventing the formation of such inorganic coatings or smoothing the surfaces of the steel sheets, for example, Patent Document 3 below describes a technique for subjecting a surface of a steel sheet to ordinary final annealing, pickling to remove surface formations and then making the surface of the steel sheet have a mirror surface through chemical polishing or electrolytic polishing. In recent years, for example, a technique or the like as described in Patent Document 4 below for preventing the formation of an inorganic coating by incorporating bismuth (Bi) or a bismuth compound in an annealing separator used at the time of final annealing has been disclosed. It has been found that a superior iron loss improving effect can be obtained by forming tension application coatings on the surfaces of the grain-oriented electrical steel sheets which are obtained through these known methods, and in which inorganic coatings are not provided or which have excellent magnetic smoothness.

However, the inorganic coatings need to have the effect of exhibiting insulating properties, serve as intermediate layers configured to secure adhesion when tension-insulation coatings are applied, and serve as intermediate layers of inorganic coatings when tension-application secondary coatings are formed on grain-oriented electrical steel sheets in which inorganic coatings are not provided.

That is to say, although an inorganic coating is formed on a surface of a steel sheet which has been subjected to final annealing when a grain-oriented electrical steel sheet is manufactured through an ordinary manufacturing process, such an inorganic coating is formed in a state of deeply entering the steel sheet. Thus, the inorganic coating has good adhesion to the steel sheet made of a metal. For this reason, it is possible to form a tension-insulation coating containing colloidal silica, phosphate, and the like as a main component on a surface of an inorganic coating. Incidentally, in general, a metal does not easily bond to oxides. Thus, when there is no inorganic coating, sufficient adhesion is not easily secured between a tension-insulation coating and a surface of an electrical steel sheet.

As a method for improving the adhesion between a steel sheet and a tension-insulation coating as described above, for example, Patent Document 5 below describes a technique for forming an iron-based oxide by annealing a grain-oriented electrical steel sheet which does not include an inorganic coating in an acidic atmosphere, forming a $SiO_2$ coating on a surface of a steel sheet by further annealing the grain-oriented electrical steel sheet in a weakly reducing atmosphere, and then forming a tension-insulation coating.

Also, as a method for improving iron loss in a grain-oriented electrical steel sheet which does not have an inorganic coating, for example, Patent Document 6 below describes a technique for forming a nitride/oxide layer which contains Si as an under-coating of a tension-insulation coating by attaching Si in an active state to a surface of the grain-oriented electrical steel sheet which does not have an inorganic coating and then forming the tension-insulation coating.

CITATION LIST

Patent Document

[Patent Document 1]
Japanese Unexamined Patent Application, First Publication No. S48-39338
[Patent Document 2]
Japanese Unexamined Patent Application, Second Publication No. S58-26405

[Patent Document 3]
Japanese Unexamined Patent Application, First Publication No. S49-96920
[Patent Document 4]
Japanese Unexamined Patent Application, First Publication No. H7-54155
[Patent Document 5]
Japanese Patent No. 4041289
[Patent Document 6]
Japanese Patent No. 4300604

SUMMARY OF THE INVENTION

Problems to be Solved by the Invention

However, even when the techniques disclosed in Patent Document 5 and Patent Document 6 above are used, there is a room for improvement in adhesion and iron loss in a grain-oriented electrical steel sheet which does not have an inorganic coating.

Therefore, the present invention was made in view of the above problems, and an object of the present invention is to provide a grain-oriented electrical steel sheet and a method for manufacturing the same in which the adhesion of a tension-insulation coating is stably improved and excellent magnetic characteristics can be realized even when the grain-oriented electrical steel sheet does not have an inorganic coating.

Means for Solving the Problem

In order to achieve the above object, as a result of diligent research by the inventors of the present invention, it was found that the adhesion of a tension-insulation coating is stably improved and excellent magnetic characteristics can be realized by subjecting a grain-oriented electrical steel sheet which does not have an inorganic coating to a pickling treatment using a specific acid and a heating treatment and then further subjecting the grain-oriented electrical steel sheet to a pickling treatment to form an iron-based oxide layer and a silicon-containing oxide layer in a specific state between the tension-insulation coating and a base steel sheet.

The gist of the present invention completed on the basis of the above findings is as follows.

[1] A grain-oriented electrical steel sheet according to an aspect of the present invention is a grain-oriented electrical steel sheet which does not have an inorganic coating containing forsterite as a main component, including:

a base steel sheet;

a silicon-containing oxide layer provided on the base steel sheet;

an iron-based oxide layer provided on the silicon-containing oxide layer; and a tension-insulation coating provided on the iron-based oxide layer, having a thickness of 1 to 3 μm, and containing phosphate and colloidal silica as main components, wherein the base steel sheet contains, in terms of mass %, 2.5 to 4.5% of Si, 0.05 to 1.00% of Mn, 0% or more and less than 0.05% of Al, 0% or more and less than 0.1% of C, 0% or more and less than 0.05% of N, 0% or more and less than 0.1% of S, 0% or more and less than 0.05% of Se, 0% or more and less than 0.01% of Bi, and the remainder: Fe and impurities as chemical components, and when the tension-insulation coating undergoes elemental analysis using a glow discharge optical emission spectrometry in a sheet thickness direction from a surface of the tension-insulation coating, (a) there are two or more peaks of a Si emission intensity;

(b) a peak A which is a peak of the Si emission intensity existing furthest to the base steel sheet side in the sheet thickness direction exists between an inflection point at which a rate of increase in an Fe emission intensity in the sheet thickness direction from the surface of the tension-insulation coating changes and a saturation point at which the Fe emission intensity become saturated; and (c) when a length of a perpendicular line when a perpendicular line is drawn from the top portion of a peak to a baseline connecting valley portions closest to the peak is defined as a peak height, a peak height of the peak A is 0.30 times or more and 2.5 times or less the Si emission intensity in the base steel sheet.

[2] In the grain-oriented electrical steel sheet according to [1], the silicon-containing oxide layer may contain silica and fayalite as main components, and the tension-insulation coating may contain 25 to 45 mass % of colloidal silica and the remainder may be one or more selected from the group consisting of aluminum phosphate, magnesium phosphate, zinc phosphate, manganese phosphate, cobalt phosphate, and iron phosphate.

[3] In the grain-oriented electrical steel sheet according to [1] or [2], the iron-based oxide layer may contain magnetite, hematite, and fayalite as main components.

[4] In the grain-oriented electrical steel sheet according to any one of [1] to [3], a thickness of the base steel sheet may be 0.27 mm or less.

[5] A method for manufacturing a grain-oriented electrical steel sheet according to another aspect of the present invention is a method for manufacturing a grain-oriented electrical steel sheet which includes a base steel sheet and a tension-insulation coating and does not have an inorganic coating containing forsterite as a main component, including:

a washing process of cleaning a surface of the grain-oriented electrical steel sheet;

a first surface treatment process of treating the surface of the grain-oriented electrical steel sheet which has been subjected to the washing process using a first treatment liquid which contains one or more of sulfuric acid, phosphoric acid, and nitric acid and having a total acid concentration of 2 to 20% and a liquid temperature of 70 to 90° C.;

a heating treatment process of heating the grain-oriented electrical steel sheet which has been subjected to the first surface treatment process at a temperature of 700 to 900° C. for 10 to 60 seconds in an atmosphere having an oxygen concentration of 1 to 21% by volume and a dew point of −20 to 30° C.;

a second surface treatment process of treating the surface of the grain-oriented electrical steel sheet which has been subjected to the heating treatment process for 1 to 10 seconds using a second treatment liquid which contains one or more of sulfuric acid, phosphoric acid, and nitric acid and having a total acid concentration of 1 to 10%; and a tension-insulation coating forming process of forming a tension-insulation coating which has a thickness of 1 to 3 μm and contains phosphate and colloidal silica as main components on the surface of the grain-oriented electrical steel sheet which has been subjected to the second surface treatment process.

[6] In the method for manufacturing a grain-oriented electrical steel sheet according to [5], the method for manufacturing a grain-oriented electrical steel sheet may further include, before the washing process, a hot rolling process of subjecting a steel piece which contains, in terms of mass %, 2.5 to 4.5% of Si, 0.05 to 1.00% of Mn, 0.05% or less of Al, 0.1% or less of C, 0.05% or less of N, 0.1% or less of S, 0.05% or less of Se, 0.01% or less of Bi, and the remainder: Fe and impurities as chemical components to hot rolling;

an optional annealing process;

a cold rolling process of performing one cold rolling or two or more cold rollings having intermediate annealing performed between the cold rollings;

a decarburization annealing process; and a final annealing process of applying an annealing separator obtained by incorporating bismuth chloride into a mixture of MgO and $Al_2O_3$ or an annealing separator obtained by incorporating a bismuth compound and a metallic chlorine compound into a mixture of MgO and $Al_2O_3$, drying the annealing separator, and then performing final annealing.

Effects of the Invention

As described above, according to the present invention, it is possible to stably improve the adhesion of a tension-insulation coating and realize excellent magnetic characteristics even when a grain-oriented electrical steel sheet does not have an inorganic coating.

EMBODIMENTS FOR IMPLEMENTING THE INVENTION

Figure 1:
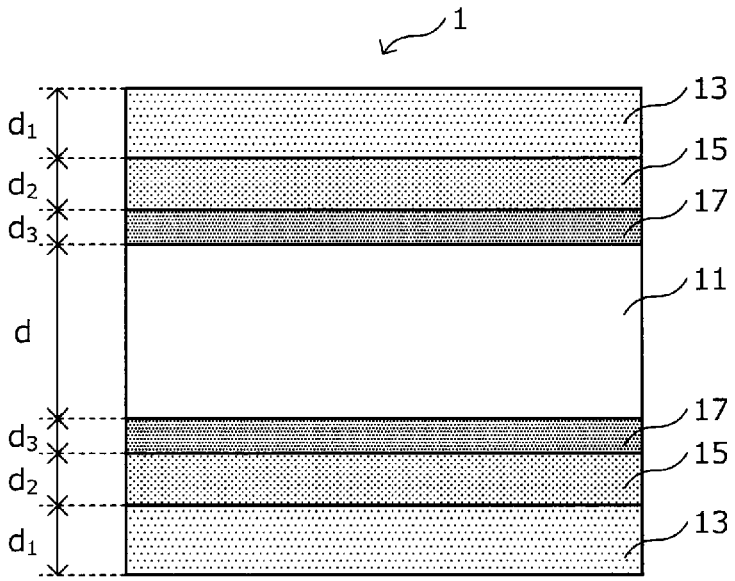
FIG. 1 is a schematic explanatory diagram of an example of a structure of a grain-oriented electrical steel sheet according to an embodiment of the present invention.

Preferred embodiments of the present invention will be described in detail below with reference to the accompanying drawings. In this specification and the drawings, constituent elements having substantially the same functional constitution will be denoted by the same reference numerals and duplicate description thereof will be omitted.

Regarding Grain-Oriented Electrical Steel Sheet

Figure 2:
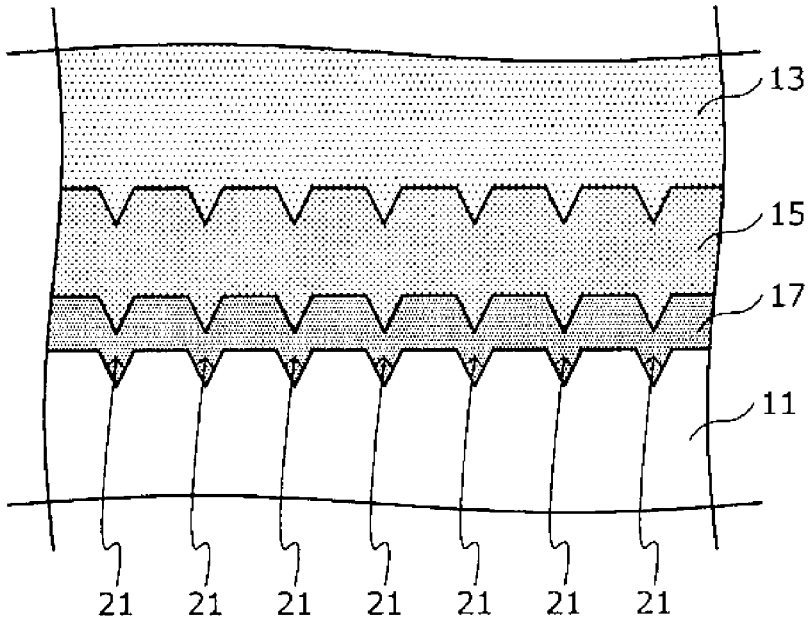
FIG. 2 is an explanatory diagram for explaining the grain-oriented electrical steel sheet according to the embodiment.

First, a grain-oriented electrical steel sheet according to an embodiment of the present will be described in detail with reference to FIGS. 1 and 2. FIG. 1 is a schematic explanatory diagram of an example of a structure of the grain-oriented electrical steel sheet according to this embodiment. FIG. 2 is an explanatory diagram for explaining the grain-oriented electrical steel sheet according to this embodiment.

The inventors of the present invention have found that (1) for example, for a high magnetic field iron loss such as 1.7 T to 1.9 T, iron loss is significantly reduced when an inorganic coating such as forsterite ($Mg_2SiO_4$) is removed, and that (2), in order to form a tension-insulation coating in which a high tension of 1.0 kgf/mm$^2$ or more is exhibited and which has a good adhesion on a surface of a steel sheet which does not have an inorganic coating, forming of a silicon-containing oxide layer and an iron-based oxide layer in order on the surface of the steel sheet is required and a good adhesion and high magnetic field iron loss of the tension-insulation coating is provided by forming such a silicon-containing oxide layer and an iron-based oxide layer. Based on the above findings, the inventors of the present invention have come up with the grain-oriented electrical steel sheet according to this embodiment.

A grain-oriented electrical steel sheet 1 according to this embodiment is a grain-oriented electrical steel sheet which does not have an inorganic coating containing forsterite as a main component, and as schematically illustrated in FIG. 1, includes:

a base steel sheet 11;

a silicon-containing oxide layer 17 which is provided on the base steel sheet;

an iron-based oxide layer 15 which is provided on the silicon-containing oxide layer; and a tension-insulation coating 13 which is provided on the iron-based oxide layer, has a thickness of 1 to 3 μm, and contains phosphate and colloidal silica as main components.

As schematically illustrated in FIG. 1, the silicon-containing oxide layer 17, the iron-based oxide layer 15, and the tension-insulation coating 13 are provided on both surfaces of the base steel sheet 11. Although FIG. 1 illustrates a case in which the silicon-containing oxide layer 17, the iron-based oxide layer 15, and the tension-insulation coating 13 are provided on both surfaces of the base steel sheet 11, the silicon-containing oxide layer 17, the iron-based oxide layer 15, and the tension-insulation coating 13 may be provided only on one surface of the base steel sheet 11 in some cases.

The base steel sheet 11, the tension-insulation coating 13 (hereinafter, may be simply abbreviated as an "insulation coating" in some cases), the iron-based oxide layer 15, and the silicon-containing oxide layer 17 included in the grain-oriented electrical steel sheet 1 according to this embodiment will be described in detail below.

Regarding Base Steel Sheet 11

Generally, although a grain-oriented electrical steel sheet contains silicon (Si) as a chemical component, silicon is extremely easily oxidized. Thus, a silicon-containing oxide coating (more specifically, an oxide coating containing silica as a main component) is formed on a surface of a steel sheet which has been subjected to decarburization annealing. After an annealing separator is applied to the surface of the steel sheet which has been subjected to decarburization annealing, the steel sheet is wound to have a coil shape and subjected to final annealing. In an ordinary method for manufacturing a grain-oriented electrical steel sheet, an inorganic coating containing forsterite ($Mg_2SiO_4$) as a main component is formed by causing MgO and an oxide coating of the surface of the steel sheet to react with each other during final annealing using an annealing separator containing MgO as a main component. However, the grain-oriented electrical steel sheet 1 according to this embodiment is not a grain-oriented electrical steel sheet which has an inorganic coating containing forsterite as a main component as described above formed on a surface thereof and a grain-oriented electrical steel sheet which does not have an inorganic coating containing forsterite as a main component formed on a surface thereof is used as the base steel sheet 11.

A method for manufacturing a grain-oriented electrical steel sheet which does not have an inorganic coating containing forsterite as a main component on a surface will be described again below.

In the grain-oriented electrical steel sheet 1 according to this embodiment, the grain-oriented electrical steel sheet used as the base steel sheet 11 is not particularly limited and a grain-oriented electrical steel sheet containing known chemical components can be utilized. Examples of such a grain-oriented electrical steel sheet include a grain-oriented electrical steel sheet containing, in terms of mass %, 2.5 to 4.5% of Si, 0.05 to 1.00% of Mn, 0% or more and less than 0.05% of Al, 0% or more and less than 0.1% of C, 0% or more less than 0.05% of N, 0% or more and less than 0.1% of S, 0% or more and less than 0.05% of Se, 0% or more and less than 0.01% of Bi, and the remainder: Fe and impurities as chemical components.

When the Si content in the base steel sheet is 2.5 mass % or more, it is possible to obtain desired magnetic characteristics. On the other hand, when the Si content in the base steel sheet is more than 4.5 mass %, a brittle steel sheet is provided, which makes manufacturing difficult. For this reason, the Si content in the base steel sheet is 4.5 mass % or less.

When the Mn content in the base steel sheet is 0.05 mass % or more, it is possible to secure an absolute amount of MnS which is an inhibitor required for causing secondary recrystallization. On the other hand, when the Mn content in the base steel sheet is more than 1.00 mass %, in secondary recrystallization annealing, steel undergoes phase transformation, sufficient secondary recrystallization does not proceed, and good magnetic flux density and iron loss characteristics may not be able to be obtained. For this reason, the Mn content in the base steel sheet is 1.00 mass % or less.

In addition to Si and Mn, the base steel sheet may contain less than 0.05 mass % of Al, less than 0.1 mass % of C, less than 0.05 mass % of N, less than 0.1 mass % of S, less than 0.05 mass % of Se, and less than 0.01 mass % of Bi as chemical components. Since these elements do not need to be contained, a lower limit is 0 mass %.

When the Al content in the base steel sheet is more than 0 mass % and less than 0.05 mass %, it is possible to improve the iron loss characteristics while minimizing the embrittlement of the steel sheet.

When the C content in the base steel sheet is more than 0 mass % and less than 0.1 mass %, it is possible to realize good magnetic flux density and iron loss characteristics.

When the N content in the base steel sheet is more than 0 mass % and less than 0.05 mass %, it is possible to minimize a decrease in passability at the time of manufacturing.

When the S content in the base steel sheet is more than 0 mass % and less than 0.1 mass %, it is possible to minimize the embrittlement of the steel sheet.

When the Se content in the base steel sheet is 0 mass % or more and less than 0.05 mass %, it is possible to realize the magnetic improvement effect.

When the Bi content in the base steel sheet is 0 mass % or more and less than 0.01 mass %, it is possible to realize good magnetic flux density and iron loss characteristics.

A microstructure 21 as schematically illustrated in FIG. 2 which is also called an etch pit is provided on a surface of the base steel sheet 11 according to this embodiment. In the method for manufacturing a grain-oriented electrical steel sheet according to this embodiment which will be describe later, the microstructure 21 is formed by causing a first treatment liquid containing a specific acid to act on the surface of the grain-oriented electrical steel sheet which does not have an inorganic coating and has been subjected to final annealing to react. When the microstructure 21 as schematically illustrated in FIG. 2 is provided on the surface of the base steel sheet 11, the adhesion between the silicon-containing oxide layer 17 and the iron-based oxide layer 15 formed on the surface of the base steel sheet 11 and the base steel sheet 11 are further improved due to a so-called anchor effect.

Regarding Tension-Insulation Coating 13

The tension-insulation coating 13 is provided on the surface of the grain-oriented electrical steel sheet 1 according to this embodiment. The tension-insulation coating 13 reduces the eddy current loss by imparting electrical insulating properties to the grain-oriented electrical steel sheet and reduces the iron loss of the grain-oriented electrical steel sheet. Furthermore, the tension-insulation coating 13 exhibits various characteristics such as corrosion resistance, heat resistance, and slipperiness in addition to the above-described electrical insulating properties.

Also, the tension-insulation coating 13 has a function of applying tension to the grain-oriented electrical steel sheet. The tension-insulation coating 13 can reduce the iron loss of the grain-oriented electrical steel sheet by applying tension to the grain-oriented electrical steel sheet to facilitate a domain wall motion in the grain-oriented electrical steel sheet.

The tension-insulation coating 13 is a tension-insulation coating of a phosphate silica mixed system containing phosphate and colloidal silica as a main component. It is desirable that such a tension-insulation coating of the phosphate silica mixed system contain, for example, 25 to 45 mass % of colloidal silica and the remainder be mainly composed of one or more selected from the group consisting of aluminum phosphate, magnesium phosphate, zinc phosphate, manganese phosphate, cobalt phosphate, and iron phosphate.

A thickness (a thickness $d_1$ in FIG. 1) of the tension-insulation coating 13 of the phosphate silica mixed system is within the range of 1 to 3 μm. When the thickness of the tension-insulation coating 13 is less than 1 μm, it is not possible to sufficiently improve various characteristics such as electrical insulating properties, corrosion resistance, heat resistance, slipperiness, and tension-application properties as described above. On the other hand, when the thickness of the tension-insulation coating 13 is more than 3 μm, a space factor of the base steel sheet 11 decreases, which is not preferable. When the thickness of the tension-insulation coating 13 is within the range of 1 to 3 μm, it is possible to realize a high tension of 1.0 kgf/mm$^2$ or more. The thickness $d_1$ of the tension-insulation coating 13 is preferably within the range of 2.5 to 3.0 μm.

Regarding Iron-Based Oxide Layer 15

In the grain-oriented electrical steel sheet 1 according to this embodiment, the iron-based oxide layer 15 functions as an intermediate layer between the base steel sheet 11 and the tension-insulation coating 13 together with the silicon-containing oxide layer 17 which will be described later. The iron-based oxide layer 15 contains, for example, an iron-based oxide such as magnetite ($Fe_3O_4$), hematite ($Fe_2O_3$), and fayalite ($Fe_2SiO_4$) as a main component.

Since the iron-based oxide which is a main component of the iron-based oxide layer 15 is formed through the surface of the base steel sheet 11 and oxygen reacting each other, a good adhesion between the iron-based oxide layer 15 and the base steel sheet 11 is provided. Furthermore, as described above, the microstructure 21 also called an etch pit schematically illustrated in FIG. 2 is provided on the surface of the base steel sheet 11. For this reason, the iron-based oxide layer 15 formed in the microstructure 21 can further improve the adhesion between the iron-based oxide layer 15 and the base steel sheet 11 due to a so-called anchor effect together with the silicon-containing oxide layer 17 which will be described later.

Generally, improving the adhesion between a metal and ceramics may not be easy in many cases. On the other hand, when the iron-based oxide layer 15 is provided between the base steel sheet 11 and the tension-insulation coating 13 which is a type of ceramics in the grain-oriented electrical steel sheet 1 according to this embodiment, even though the inorganic coating is not formed on the surface of the base steel sheet 11, it is possible to improve the adhesion of the tension-insulation coating 13.

Also, in the method for manufacturing a grain-oriented electrical steel sheet according to this embodiment, the surface of the iron-based oxide layer 15 has the microstructure as illustrated in FIG. 2 formed through a pickling treatment using a second treatment liquid. For this reason, it is possible to further improve the adhesion between the iron-based oxide layer 15 and the tension-insulation coating 13.

In the grain-oriented electrical steel sheet 1 according to this embodiment, a thickness (a thickness $d_2$ in FIG. 1) of the iron-based oxide layer 15 is preferably within the range of 100 to 500 nm. When the thickness $d_2$ of the iron-based oxide layer 15 is less than 100 nm, the iron-based oxide layer 15 and the silicon-containing oxide layer 17 will be dissolved due to an acidic treatment liquid used when the tension-insulation coating 13 is formed, which is not likely to obtain a sufficient adhesion. On the other hand, when the thickness $d_2$ of the iron-based oxide layer 15 is more than 500 nm, the iron-based oxide layer 15 is too thick, which is highly likely to increase partial peeling. In the grain-oriented electrical steel sheet 1 according to this embodiment, the thickness $d_2$ of the iron-based oxide layer 15 is preferably within the range of 150 to 400 nm, and more preferably within the range of 170 to 250 nm.

The thickness $d_2$ of the iron-based oxide layer 15 can be specifically identified, for example, by observing a distribution of iron-oxygen bonds with respect to a cross section of the grain-oriented electrical steel sheet 1 according to this embodiment using an X-ray photoelectron spectroscopy (XPS). That is to say, sputtering is performed from the surface of the grain-oriented electrical steel sheet 1 from which the tension-insulation coating 13 has been removed toward the base steel sheet 11 side while paying attention to an intensity of Fe—O peaks appearing at 712 eV and an intensity of metal Fe peaks appearing at 708 eV using an XPS and a distance from the outermost layer in which the measurement starts to a position in a depth direction in which the intensity of Fe—O peaks appearing at 712 eV and the intensity of metal Fe peaks appearing at 708 eV are interchanged can be defined as the thickness of the iron-based oxide layer 15.

A main component of the iron-based oxide layer 15 can be specifically identified by performing analysis using an X-ray crystal structure analysis method or an XPS. It has been found from the measurement results so far by the inventors of the present invention that the iron-based oxide layer 15 mainly contains an iron oxide as a main component and contains a small amount of silica.

Regarding Silicon-Containing Oxide Layer 17

In the grain-oriented electrical steel sheet 1 according to this embodiment, the silicon-containing oxide layer 17 is a layer configured to function as an intermediate layer between the base steel sheet 11 and the tension-insulation coating 13 together with the iron-based oxide layer 15 described above. The silicon-containing oxide layer 17 contains silica and fayalite ($Fe_2SiO_4$) as main components.

As will be described in detail later, the microstructure 21 also called an etch pit as illustrated in FIG. 2 is formed on the surface of the base steel sheet 11 by treating the surface of the grain-oriented electrical steel sheet which does not have an inorganic coating using a treatment liquid containing at least one of sulfuric acid, nitric acid, and phosphoric acid so that the adhesion of the tension-insulation coating 13 is secured. Here, the inventors of the present invention have found that, when the adhesion of the tension-insulation coating in the grain-oriented electrical steel sheet in which the microstructure has been formed on the surface of the base steel sheet has been subjected to further detailed verification, there are parts with good adhesion and parts with poor adhesion under the certain manufacturing conditions.

As a result of verifying the above phenomenon, it has been found that, in the parts with good adhesion, a silicon-containing oxide layer mainly composed of silica derived from Si which has diffused from the base steel sheet and fayalite ($Fe_2SiO_4$) is formed on an underlayer side (the base steel sheet side) of the iron-based oxide layer, and in the parts with poor adhesion, there is no iron-based oxide layer or silicon-containing oxide layer. The fact that small amounts of the iron-based oxide layer and the silicon-containing oxide layer to exist are provided (in other words, thin thicknesses are provided) is conceivable as one of the reasons why the iron-based oxide layer and the silicon-containing oxide layer do not exist. It is presumed that, since an acidic treatment liquid is utilized for forming a tension-insulation coating, the effect of adhesion improvement is reduced by dissolving the thin iron-based oxide layer and silicon-containing oxide layer at the time of forming the tension-insulation coating. Furthermore, the fact that an excessive amount of iron-based oxide layer is likely to be generated is conceivable as another possible reason. It is presumed that, when an excessive amount of iron-based oxide layer is generated, an iron oxide (smudge) isolated from a surface is generated, and thus the treatment liquid used for forming the tension-insulation coating does not adhere to the surface of the steel sheet.

It is clear from the above findings that forming the iron-based oxide layer and the silicon-containing oxide layer in an appropriate state is important to realize good adhesion of the tension-insulation coating.

It is clear based on the above findings that, when the grain-oriented electrical steel sheet with good adhesion is analyzed using a glow discharge optical emission spectrometry (a glow discharge spectrometry: GDS), characteristic peaks are observed in the obtained GDS chart.

Figure 3A:
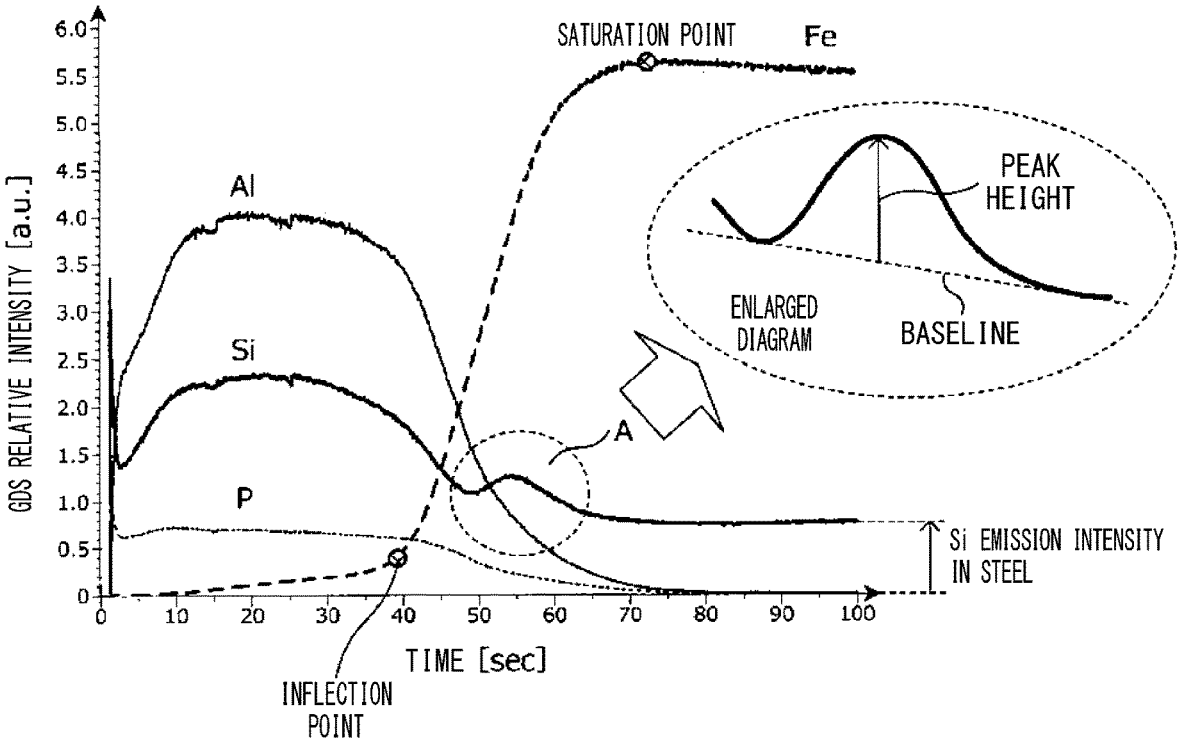
FIG. 3A is a graph diagram illustrating an example of an analysis result using a glow discharge optical emission spectrometry of the grain-oriented electrical steel sheet according to the embodiment.
Figure 3B:
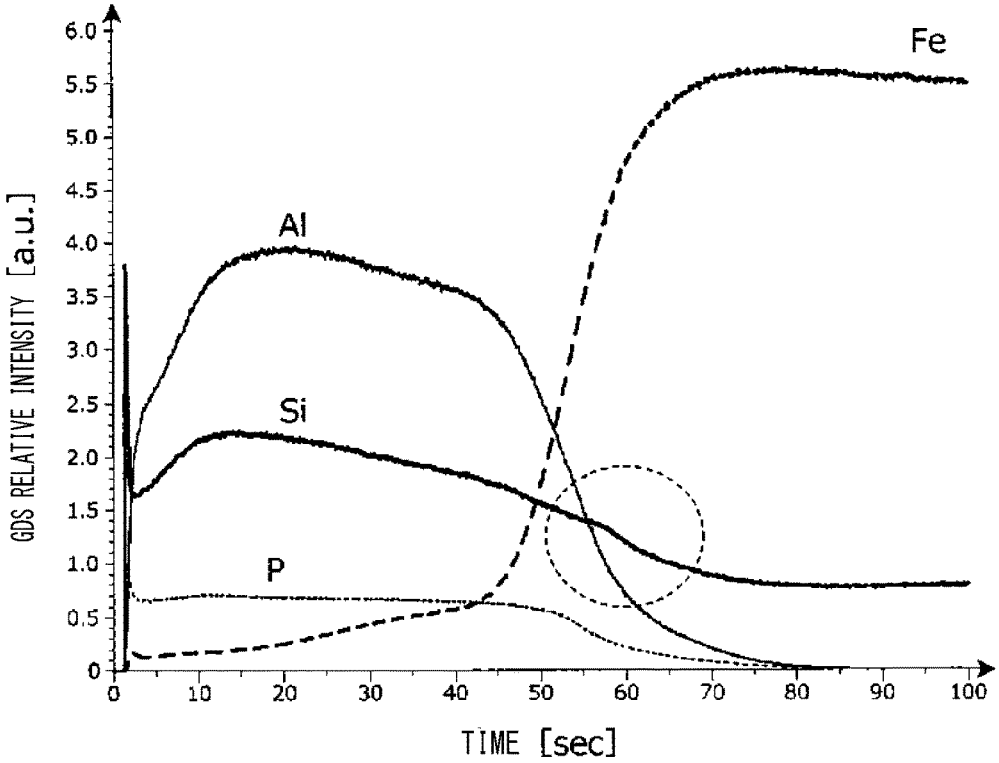
FIG. 3B is a graph diagram illustrating an example of an analysis result using a glow discharge optical emission spectrometry of the grain-oriented electrical steel sheet having a poor adhesion of a tension-insulation coating.

FIG. 3A illustrates an example of the analysis result using a GDS of the grain-oriented electrical steel sheet with good adhesion and FIG. 3B illustrates an example of the analysis result using a GDS of the grain-oriented electrical steel sheet with poor adhesion. For each grain-oriented electrical steel sheet, a tension-insulation coating is formed using a treatment liquid containing colloidal silica and aluminum phosphate. In FIGS. 3A and 3B, the horizontal axis indicates an elapsed time [second] from the start of analysis and the vertical axis indicates a GDS relative intensity [a.u.]. Since a GDS is a method for analyzing a surface of a sample toward a deeper part in a thickness direction while performing sputtering, when an elapsed time increases, it means that a deeper part of a sample is analyzed. Furthermore, in FIGS. 3A and 3B, for elements other than Fe, the three-times-enlarged obtained results are illustrated in the drawings.

Referring to FIGS. 3A and 3B, light emission peaks derived from Al and light emission peaks derived from Si are acknowledged in a region in which an elapsed time is about 0 seconds to 40 seconds. Furthermore, it seems that a GDS relative intensity derived from P also slightly increases in the vicinity of 5 seconds and then gradually decays, and there are gentle and broadly distributed light emission peaks derived from P. Since theses peaks contain Al, Si, and P, they are derived from the tension-insulation coating 13. In addition, since the light emission peaks derived from Fe increase when an elapsed time increases, it can be seen that the iron-based oxide layer is formed.

When attention is paid to the GDS analysis result of the grain-oriented electrical steel sheet with good adhesion illustrated in FIG. 3A, it can be seen that the light emission peaks derived from Al and the light emission peaks derived from P decrease monotonically, whereas a second light emission peak derived from Si (hereinafter, may be referred to as a "peak A") is observed in the region A surrounded by the broken line in FIG. 3A. The second light emission peak (the peak A) exists between an inflection point at which a rate of increase in light emission peak intensity derived from Fe changes (in the case of FIG. 3A, a point in which an elapsed time is about 40 seconds) and a point at which the light emission peak intensity derived from Fe saturates (in the case of FIG. 3A, a position in which an elapsed time is about 70 seconds; hereinafter may be referred to as a "saturation point"). Although a second light emission peak (a peak A) derived from Si has a different elapsed time at which peaks are observed, the second light emission peak (a peak A) derived from Si is observed in all of the grain-oriented electrical steel sheets with good adhesion. Therefore, it can be seen that the second light emission peak (the peak A) is derived from the silicon-containing oxide layer containing silica and fayalite ($Fe_2SiO_4$) as main components.

Also, as illustrated in the enlarged part of FIG. 3A, when a line segment connecting valley portions close to a second Si-derived peak (a peak A) is defined as a baseline, a length of a perpendicular line drawn from a peak top portion of the second Si-derived peak (the peak A) to the baseline is defined as a peak height of the peak A. It is clarified that the peak height of the peak A is 0.30 times or more and 2.5 times or less of a Si emission intensity in the steel (that is, a light emission intensity of a portion in which the sputtering proceeds to a portion of the base steel sheet and an intensity of the light emission peaks derived from Si becomes a steady state) in all of the grain-oriented electrical steel sheets with good adhesion. On the other hand, it is clarified that, when the peak height of the peak A is less than 0.30 times or more than 2.5 times the Si emission intensity in the base steel sheet, the tension-insulation coating has inferior adhesion.

As described above, it is clarified that good adhesion is provided when a portion in which a Si element is segregated at a certain depth position of the grain-oriented electrical steel sheet is the silicon-containing oxide layer 17 in this embodiment and a Si element in a portion corresponding to the silicon-containing oxide layer 17 (the region A in FIG. 3A) has a specific concentration (0.30 times or less of the Si emission intensity in the steel). Since the segregated portion of the Si element is derived from the inside of Si diffusing from the base steel sheet, the segregated portion of the Si element exists at a position close to the base steel sheet.

On the other hand, it can be seen that, although the second peaks derived from Si as described above is slightly observed in the GDS analysis result of the grain-oriented electrical steel sheet with poor adhesion illustrated in FIG. 3B, the height of such peaks are not 0.30 times or more and 2.5 times or less the Si emission intensity in the steel. It is also clarified that, when the other grain-oriented electrical steel sheets with poor adhesion are analyzed using a GDS, the second peaks derived from Si may not be observed.

Since a GDS is a method for performing analyzing while sputtering a region having a diameter of about 5 mm, it can be conceivable that, in the GDS analysis result as illustrated in FIG. 3A, an average behavior of each element in a region having a diameter of about 5 mm of a sample is observed. Therefore, in a coil in which the grain-oriented electrical steel sheet is wound, when the GDS analysis result of an optional region at a position away from a head portion of the coil by an optional distance shows the behavior as illustrated in FIG. 3A, a portion of the coil having the same distance from the head portion thereof is considered to show the same GDS analysis result that is shown in FIG. 3A. Furthermore, if the GDS analysis result shows the behavior as shown in FIG. 3A at both the head portion and a tail portion of the coil, it can be conceivable that the GDS analysis result shows the behavior as illustrated in FIG. 3A in the entire coil.

As described above, in the grain-oriented electrical steel sheet 1 according to this embodiment, when the grain-oriented electrical steel sheet 1 undergoes elemental analysis using a glow discharge optical emission spectrometry (GDS) in a sheet thickness direction from the surface of the grain-oriented electrical steel sheet 1, there is the silicon-containing oxide layer 17 in which all of the following conditions (a) to (c) are satisfied.

(a) There are two or more peaks of a Si emission intensity.

(b) A peak A which is a peak of the Si emission intensity existing furthest to the base steel sheet side in the sheet thickness direction exists between an inflection point at which a rate of increase in Fe emission intensity in the sheet thickness direction from the surface of the tension-insulation coating changes and a saturation point at which the Fe emission intensity saturates.

(c) When a length of a perpendicular line when the perpendicular line is drawn from the top portion of a peak to a baseline connecting valley portions close to the peak is defined as a peak height, a peak height of a peak A is 0.30 times or more and 2.5 times or less a Si emission intensity in the base steel sheet.

The reason why the number of peaks of the Si emission intensity is two or more in the above condition (1) is as follows. When the grain-oriented electrical steel sheet is analyzed using a GDS, shoulders (overlapping of peaks) may occur in the Si light emission peak derived from the tension-insulation coating in accordance with a state of the tension-insulation coating, and in FIG. 3A, there may be a case in which light emission peaks which are viewed as one peak appear as two or more peaks.

Furthermore, in the grain-oriented electrical steel sheet, in order to apply stronger tension, a tension-insulation coating may be formed multiple times while changing a Si concentration of a treatment liquid in some cases. In this case, a plurality of light emission peaks derived from the tension-insulation coating are observed at a left end portion of the GDS analysis result as illustrated in FIG. 3A (a short elapsed time=a surface layer side of the grain-oriented electrical steel sheet). However, even when the number of peaks of the Si emission intensity is 3 or more, the segregated portion of Si to which attention is to be paid is derived from Si diffusing from the inside of the base steel sheet. Thus, attention may be paid to a peak (the peak A) which exists furthest to the base steel sheet side among the plurality of observed peaks.

The silicon-containing oxide layer 17 is formed when the surface of the base steel sheet 11 is subjected to a pickling treatment used for forming the microstructure 21 using the first treatment liquid and then a heating treatment is performed at a predetermined temperature.

The conditions when a depth direction analysis using a GDS is performed from the surface of the grain-oriented electrical steel sheet are as follows. When the depth direction analysis using a GDS is performed under the following conditions, it is possible to obtain the GDS analysis result as illustrated in FIG. 3A in the grain-oriented electrical steel sheet with good adhesion. That is to say, in a high frequency mode of a general glow discharge optical emission spectroscopic analyzer (for example, GDA 750 manufactured by Rigaku Co., Ltd.), when measurement is performed under the conditions such as an output: 30 W; an Ar pressure: 3 hPa; a measurement area: 4 mmφ; and a measurement time: 100 seconds, it is possible to obtain the GDS analysis result as illustrated in FIG. 3A.

A thickness of the silicon-containing oxide layer 17 (a thickness $d_3$ in FIG. 1) may be 100 nm or less and may be often about 20 to 30 nm in some cases. The thickness of the silicon-containing oxide layer 17 can be calculated from a sputtering rate in a GDS and an elapsed time width in which the second peak derived from Si is observed as illustrated in the region A of FIG. 3A.

A main component of the silicon-containing oxide layer 17 can be specifically identified through analysis using an X-ray crystal structure analysis method or an XPS.

Regarding Thickness of Base Steel Sheet 11

In the grain-oriented electrical steel sheet 1 according to this embodiment, a thickness of the base steel sheet 11 (the thickness d in FIG. 1) is not particularly limited and may be, for example, 0.27 mm or less. Generally, in the grain-oriented electrical steel sheet, when a thin thickness of the steel sheet is provided, poor adhesion of the tension-insulation coating may be provided in many cases. However, in the grain-oriented electrical steel sheet 1 according to this embodiment, when the iron-based oxide layer 15 and the silicon-containing oxide layer 17 are provided, even when the thickness d is 0.27 mm or less, it is possible to obtain good adhesion of the tension-insulation coating 13.

In this embodiment, even when the thickness d of the base steel sheet 11 is as thin as 0.23 mm or less, the tension-insulation coating 13 can obtain good adhesion. In the grain-oriented electrical steel sheet 1 according to this embodiment, the thickness d of the base steel sheet 11 is more preferably within the range of 0.17 to 0.23 mm. The thickness d of the base steel sheet 11 in the grain-oriented electrical steel sheet 1 according to this embodiment is not limited to the above-described range.

The grain-oriented electrical steel sheet according to this embodiment does not have an inorganic coating containing forsterite as a main component. The fact that "an inorganic coating containing forsterite as a main component is not formed" is determined using an analysis which will be illustrated later.

In order to specifically identify each layer in a cross-sectional structure, line analysis is performed in the sheet thickness direction and quantitative analysis of chemical components of each layer is performed using an energy dispersive X-ray spectroscopy (EDS) attached to a scanning electron microscope (SEM) or a transmission electron microscope (TEM). The elements to be subjected to quantitative analysis are 6 elements such as Fe, P, Si, O, Mg, and Al.

It is determined that a layered region existing at the deepest position in the sheet thickness direction which is a region in which measurement noise is removed, the Fe content is 80 atom % or more, and the O content is less than 30 atom % is a base steel sheet.

With regard to the region excluding the base steel sheet which has been specifically identified described above, it is determined that a region in which measurement noise is removed, the Fe content is less than 80 atom %, the P content is 5 atom % or more, and the O content is 30 atom % or more is a tension-insulation coating.

It is determined that the region excluding the base steel sheet and the tension-insulation coating which has been specifically identified described above is an intermediate layer composed of the silicon-containing oxide layer and the iron-based oxide layer. An intermediate layer may be adopted as long as, in the intermediate layer, the average Fe content is less than 80 atom %, the average P content is less than 5 atom %, the average Si content is 20 atom % or more, and the average O content is 30 atom % or more as an overall average. Furthermore, since the intermediate layer is not a forsterite coating in this embodiment, in the intermediate layer, the average Mg content may be satisfied to be less 20 atom %. The Mg content of the intermediate layer is preferably 10 atom % or less, more preferably 5 atom % or less, and still more preferably 3 atom % or less.

As described above, in the grain-oriented electrical steel sheet according to this embodiment, it is possible to further improve the adhesion of the tension-insulation coating 13 by providing the iron-based oxide layer 15 and the silicon-containing oxide layer 17 between the base steel sheet 11 and the tension-insulation coating 13 and, for example, it is possible to significantly reduce high magnetic field iron loss such as 1.7 T to 1.9 T.

Various magnetic characteristics such as magnetic flux density and iron loss of the grain-oriented electrical steel sheet according to this embodiment can be measured in accordance with an Epstein method stipulated in JIS C2550 or a single sheet magnetic characteristic measurement method (a single sheet tester: SST) stipulated in JIS C2556.

The grain-oriented electrical steel sheet according to this embodiment has been described in detail above.

(Regarding Method for Manufacturing Grain-Oriented Electrical Steel Sheet)

Figure 4:
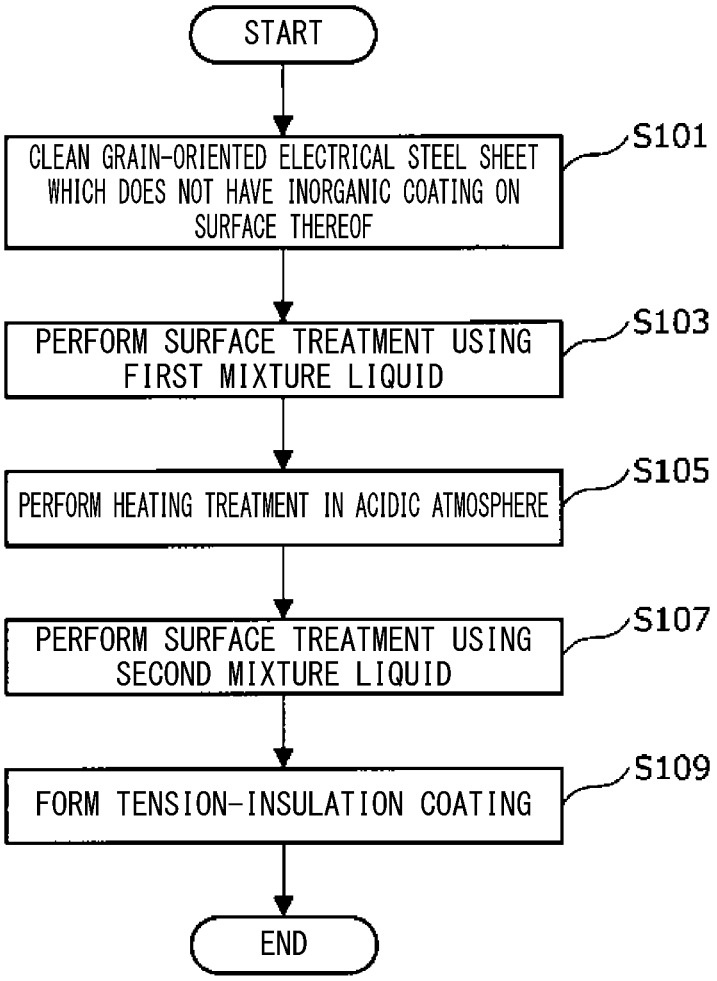
FIG. 4 is a flowchart for describing an example of a flow of a method for manufacturing a grain-oriented electrical steel sheet according to the embodiment.

Subsequently, a method for manufacturing a grain-oriented electrical steel sheet according to this embodiment will be described in detail with reference to FIG. 4. FIG. 4 is a flowchart for describing an example of a flow of the method for manufacturing a grain-oriented electrical steel sheet according to this embodiment.

In the method for manufacturing a grain-oriented electrical steel sheet according to this embodiment, as described above, a grain-oriented electrical steel sheet which contains forsterite as a main component and does not have an inorganic coating on a surface thereof (more specifically, a grain-oriented electrical steel sheet which has been subjected to final annealing and which contains forsterite as a main component and does not have an inorganic coating on a surface thereof) is used as the base steel sheet 11.

A method for obtaining a grain-oriented electrical steel sheet which does not have an inorganic coating is not particularly limited. For example, a method including: a hot rolling process of subjecting a steel piece containing, in terms of mass %, 2.5 to 4.5% of Si, 0.05 to 1.00% of Mn, 0.05% or less of Al, 0.1% or less of C, 0.05% or less of N, 0.1% or less of S, 0.05% or less of Se, 0.01% or less of Bi, and the remainder: Fe and impurities as chemical components to hot rolling; an arbitrarily annealing process; a cold rolling process of performing one cold rolling or two or more cold rolling having an intermediate annealing performed between the two or more cold rolling; a decarburization annealing process; and a final annealing process is exemplified.

Here, in order not to form an inorganic coating, for example, a method for applying an annealing separator which does not form an inorganic coating and performing final annealing, a method for performing final annealing using a commonly utilized annealing separator and then performing removing the generated inorganic coating using a known method such as grinding or pickling, and the like are exemplified.

Among the above methods, the method for performing final annealing using an annealing separator which does not form an inorganic coating is preferable because controlling is easier and a good surface of the steel sheet is also provided. As such an annealing separator, for example, it is desirable to utilize an annealing separator in which bismuth chloride is provided in a mixture of MgO and $Al_2O_3$ or an annealing separator in which a bismuth compound and a metallic chlorine compound are provided in a mixture of MgO and $Al_2O_3$.

Examples of the above-described bismuth chloride include bismuth oxychloride (BiOCl), bismuth trichloride ($BiCl_3$), and the like. Examples of the above-described bismuth compound include bismuth oxides, bismuth hydroxides, bismuth sulfides, bismuth sulfates, bismuth phosphates, bismuth carbonates, bismuth nitrates, organic acid bismuth, bismuth halide, and the like. In addition, examples of the metallic chlorine compound include iron chloride, cobalt chloride, nickel chloride, and the like.

The amount of bismuth chloride or a chlorinated product of a bismuth compound and a metal is not particularly limited, but is preferably about 3 to 15 parts by mass with respect to 100 parts by mass of a mixture of MgO and $Al_2O_3$.

Usually, when a grain-oriented electrical steel sheet is manufactured, after final annealing, an excessive annealing separator which has been attached is removed through cleaning and then flattening and annealing is performed.

On the other hand, as illustrated in FIG. 4, the method for manufacturing a grain-oriented electrical steel sheet according to this embodiment includes: removing an excessive annealing separator through cleaning using a grain-oriented electrical steel sheet which has been subjected to final annealing and does not have an inorganic coating (Step S101; a washing process); then performing a surface treatment by causing the surface of the steel sheet and a specific concentration of acid (a first treatment liquid) to react (Step S103; a first surface treatment process); performing a heating treatment at a specific temperature in an oxidizing atmosphere (Step S105; a heating treatment process); and performing a surface treatment by causing the surface of the steel sheet which has been subjected to a heating treatment and a specific concentration of acid (a second treatment liquid) to react (Step S107; a second surface treatment process). Thus, an intermediate layer mainly composed of the iron-based oxide layer and the silicon-containing oxide layer as described above is formed on the surface of the grain-oriented electrical steel sheet which has been subjected to final annealing and does not have an inorganic coating. After that, a tension-insulation coating is formed with good adhesion to the grain-oriented electrical steel sheet having the iron-based oxide layer and the silicon-containing oxide layer formed thereon (Step S109; a tension-insulation coating forming process).

Regarding First Surface Treatment Process

A first treatment liquid used in the first surface treatment process of Process S103 contains one or more of sulfuric acid, nitric acid, and phosphoric acid and has a total acid concentration of 2 to 20 mass % and a liquid temperature of 70 to 90° C. When the surface of the steel sheet is etched using the first treatment liquid, etch pits are formed in the surface of the steel sheet and it is possible to generate an active surface state which cannot normally be obtained. The microstructure 21 illustrated in FIG. 2 schematically represents the etch pits formed in the surface of the steel sheet.

When a liquid temperature of the first treatment liquid is lower than 70° C., the solubility of the first treatment liquid decreases, a precipitate is highly likely to be generated, and an effective etch pit cannot be obtained. On the other hand, when the liquid temperature of the first treatment liquid exceeds 90° C., the reactivity of the first treatment liquid is too high, which is not desirable because the surface of the steel sheet is excessively etched during the first surface treatment process.

The liquid temperature of the first treatment liquid is preferably within the range of 75 to 87° C., and more preferably within the range of 80 to 85° C.

When a total acid concentration of the first treatment liquid is less than 2 mass %, etch pits cannot be appropriately formed in the surface of the steel sheet and a treatment time is long, which is industrially disadvantageous. When the total acid concentration of the first treatment liquid exceeds 20 mass %, the surface of the steel sheet is excessively etched during the first surface treatment process, which is not preferable.

The total acid concentration of the first treatment liquid is preferably within the range of 2 to 17 mass %, and more preferably within the range of 2 to 10 mass %.

The treatment time of the first surface treatment process is not particularly limited. The first surface treatment process may be carried out by continuously immersing the steel sheet in a treatment bath having the first treatment liquid held therein in many cases. When this method is adopted, a time at which the steel sheet passes through the treatment bath is a treatment time for the first surface treatment process. When the steel sheet is immersed in and caused to pass through the treatment bath at a general sheet-passing rate, it is possible to realize the above-described active surface state.

Regarding Heating Treatment Process

In order to form the iron-based oxide layer and the silicon-containing oxide layer on the grain-oriented electrical steel sheet which has undergone the first surface treatment process, in an atmosphere in which an oxygen concentration is 1 to 21% by volume and a dew point is −20 to 30° C., heating is performed for 10 to 60 seconds so that a temperature of the steel sheet reaches 700 to 900° C. (the heating treatment process).

When the oxygen concentration in the atmosphere is less than 1% by volume, it takes too much time for the iron-based oxide layer to be formed, which deteriorates the productivity. On the other hand, when the oxygen concentration in the atmosphere exceeds 21% by volume, the iron-based oxide layer to be formed is easily non-uniform, which is not desirable. The oxygen concentration in the atmosphere is preferably within the range of 2 to 21% by volume, and more preferably within the range of 15 to 21% by volume.

When the dew point in the atmosphere is less than −20° C., it takes too much time for the iron-based oxide layer to be formed, which the productivity deteriorates. On the other hand, when the dew point in the atmosphere exceeds 30° C., the iron-based oxide layer to be formed is easily non-uniform, which is not desirable. The dew point in the atmosphere is preferably within the range of −10 to 25° C., and more preferably within the range of −10 to 20° C.

When a heating temperature of the steel sheet in the heating treatment process is less than 700° C., even if a heating time is 60 seconds, it is difficult to form the iron-based oxide layer and the silicon-containing oxide layer in an appropriate state, which is not preferable. On the other hand, when the heating temperature of the steel sheet exceeds 900° C., the iron-based oxide layer is easily non-uniform and the silicon-containing oxide layer in a desired state cannot be formed, which is not preferable. The heating temperature of the steel sheet in the heating treatment process is preferably within the range of 750 to 800° C.

When the heating time is less than 10 seconds, the iron-based oxide layer and the silicon-containing oxide layer to be generated are easily non-uniform, which is not preferable. On the other hand, when the heating time exceeds 60 seconds, the manufacturing costs industrially increase, which is not preferable. The heating time is preferably within the range of 20 to 30 seconds.

When the heating treatment process is performed after the first surface treatment process, the activated surface of the grain-oriented electrical steel sheet which does not have an inorganic coating is oxidized to form an iron-based oxide layer whose thermal expansion coefficient is positioned between those of the meal and the insulation coating and a silicon-containing oxide layer is formed of Si diffusing from the inside of the base steel sheet. When etch pits are formed in the surface of the grain-oriented electrical steel sheet and an iron-based oxide layer having a preferable thermal expansion coefficient and a silicon-containing oxide layer in a preferable segregation state are formed to alleviate strain, it is possible to realize further improvement of the adhesion of the tension-insulation coating and the effect of improving high magnetic field iron loss.

Regarding Second Surface Treatment Process

The second treatment liquid used in the second surface treatment process of Step S107 contains one or more of sulfuric acid, nitric acid, and phosphoric acid and has a total acid concentration of 1 to 10 mass %. When the surface of the iron-based oxide layer is lightly etched using the second treatment liquid, etch pits are formed in the surface of the iron-based oxide layer and it is possible to generate an active surface state which cannot normally be obtained.

The liquid temperature of the second treatment liquid is preferably 50° C. or higher and 90° C. or lower. When the liquid temperature of the second treatment liquid is lower than 50° C., the solubility of the second treatment liquid decreases, in which a precipitate is highly likely to be generated and effective etch pits cannot be obtained. On the other hand, when the liquid temperature of the second treatment liquid exceeds 90° C., the reactivity of the second treatment liquid is too high and the iron-based oxide layer and the silicon-containing oxide layer are highly likely to dissolve. The liquid temperature of the second treatment liquid is preferably within the range of 70 to 85° C., and more preferably within the range of 80 to 85° C.

When the total acid concentration of the second treatment liquid is less than 1 mass %, etch pits cannot be appropriately formed in the surface of the iron-based oxide layer and the treatment time increases, which is industrially disadvantageous. When the total acid concentration of the second treatment liquid exceeds 10 mass %, the surface of the steel sheet is excessively etched during the second surface treatment process, which is not preferable.

The total acid concentration of the second treatment liquid is preferably within the range of 1 to 5 mass %, and more preferably within the range of 1 to 3 mass %.

The treatment time of the second surface treatment process is 1 second or more and 10 seconds or less. When the treatment time is less than 1 second, etch pits cannot appropriately formed in the surface of the iron-based oxide layer. On the other hand, when the treatment time exceeds 10 seconds, the surface of the steel sheet is excessively etched during the second surface treatment process, which is not preferable.

The treatment time of the second surface treatment process is preferably within the range of 2 to 8 seconds, and more preferably within the range of 2 to 5 seconds.

Regarding Tension-Insulation Coating Forming Process

In the method for manufacturing a grain-oriented electrical steel sheet according to this embodiment, the process of forming a tension-insulation coating is not particularly limited and the insulation coating treatment liquid may be applied and dried through a known method using an insulation coating treatment liquid for the phosphate silica mixed system as will be described later. When the tension-insulation coating is formed on the surface of the steel sheet, it is possible to further improve the magnetic characteristics of the grain-oriented electrical steel sheet.

The surface of the steel sheet having the tension-insulation coating formed thereon may be subjected to any pretreatment such as a degreasing treatment using an alkali or the like before the insulation coating treatment liquid is applied or may be a surface without these pretreatments.

The tension-insulation coating formed on the surface of the steel sheet is not particularly limited as long as it is used as the tension-insulation coating for the phosphate silica mixed system of the grain-oriented electrical steel sheet and it is possible to utilize a known tension-insulation coating for a phosphate silica mixed system. Examples of such a tension-insulation coating include a coating containing phosphate and colloidal silica as main components. As another example, a composite insulation coating containing phosphate and colloidal silica as main components and having fine organic resin particles dispersed therein can be exemplified.

When the tension-insulation coating is formed, first, the insulation coating treatment liquid in which colloidal silica is contained in an amount of 25 to 45 mass % with respect to the total solid content and the remainder solid content contains one or more types selected from the group consisting of aluminum phosphate, magnesium phosphate, zinc phosphate, manganese phosphate, cobalt phosphate, and iron phosphate as a main component is adjusted.

It is desirable that the pH of the insulation coating treatment liquid be adjusted within the range of 1.2 to 3.4. When the pH of the treatment liquid is within the above range, it is possible to form a tension-insulation coating in a more suitable state.

The adjusted insulation coating treatment liquid is applied to the surface of the grain-oriented electrical steel sheet which has been subjected to the second surface treatment process through a known method so that the thickness after drying is 1 to 3 μm, dried, and fired.

Times between the first surface treatment process and the heating treatment process and between the second surface treatment process and the tension-insulation coating forming process are preferably as short as possible, for example, within several minutes.

Subsequent to the tension-insulation coating forming process, flattening and annealing for shape correction may be performed. When the flattening and annealing are performed on the steel sheet, it is possible to further reduce the iron loss.

The method for manufacturing a grain-oriented electrical steel sheet according to this embodiment has been described in detail above.

Example

The grain-oriented electrical steel sheet and the method for manufacturing a grain-oriented electrical steel sheet according to the present invention will be described in detail below with reference to examples and comparative examples. The examples which will be illustrated later are merely examples of the grain-oriented electrical steel sheet and the method for manufacturing a grain-oriented electrical steel sheet according to the present invention and the grain-oriented electrical steel sheet and the method for manufacturing a grain-oriented electrical steel sheet according to the present invention is not limited to the following examples.

Experimental Example

A hot band with a sheet thickness of 2.2 mm was obtained by casting a steel piece (a silicon steel slab) which contains, in terms of mass %; C: 0.08%; Si: 3.24%; Mn: 0.08%; Al: 0.028%; N: 0.008%; S: 0.03%; Se: 0.01%; Bi: 0.004%, and the remainder: Fe and impurities and heating the obtained steel piece and then subjecting the steel piece to hot rolling. The steel piece was subjected to annealing at a temperature of the steel sheet of 1100° C. for 60 seconds, subjected to cold rolling to have a sheet thickness of 0.22 mm, and subjected to decarburization annealing at a temperature of the steel sheet of 830° C. After that, an annealing separator which contains MgO and $Al_2O_3$ as main components and contains 10 mass % of BiOCl which is bismuth chloride is applied and dried and final annealing at a temperature of the steel sheet of 1200° C. for 20 hours (final annealing under such conditions is also referred to as "purification annealing") was performed. When the excessive annealing separator was removed through washing with water after final annealing, an inorganic coating was not formed on the surface of the steel sheet. Furthermore, as a result of such final annealing, the Al content was less than 0.05%, the C content was less than 0.1%, the N content was less than 0.05%, the S content was less than 0.1%, the Se content was less than 0.05%, and the Bi content was less than 0.01%.

The steel sheet which has been subjected to final annealing was subjected to the first surface treatment process under the conditions illustrated in Table 1, subjected to the heating treatment process under the conditions illustrated in Table 1, and then subjected to the second surface treatment process under the conditions illustrated in Table 1. After that, an insulation coating treatment liquid which contains aluminum phosphate (content: 60 mass % with respect to the total solid content) and silica (colloidal silica; average particle size of 20 nm (a catalog value); content: 40 mass % with respect to the total solid content) as main components was applied and fired to form a tension-insulation coating with a thickness of 2.5 μm.

Chemicals used for the first treatment liquid and the second treatment liquid were both commercially available general special grade reagents and commercially available general special grade reagents were used for aluminum phosphate and colloidal silica.

For each of the grain-oriented electrical steel sheets manufactured in this way, a thickness $d_2$ of the iron-based oxide layer was measured in accordance with the above method using an XPS (PHI5600 manufactured by ULVAC-PHI) and the main components of the iron-based oxide layer were specifically identified using an X-ray crystal structure analysis method. Furthermore, the obtained grain-oriented electrical steel sheets were analyzed in accordance with the following analysis conditions using a GDS (glow discharge emission analyzer GDA750 manufactured by Rigaku).

XPS measurement condition

X-ray source: MgKα

Analytical area: about 800 pump

Depth direction analysis (sputtering yield: 2 nm/min in terms of $SiO_2$)

Measurement elements: C, O, Al, Si, and Fe

Measurement surface: outmost surface, after sputtering for 0.1, 0.5, 1, 2, 5, 10, 20, 30, 40, 50, 60, 70, 80, 90, and 100 minutes GDS measurement condition High frequency mode Output: 30 W Ar pressure: 3 hPa Measurement area: 4 mmφ

Measurement time: 100 seconds

Measurement elements: O, Al, Si, P, and Fe

Also, high magnetic field iron loss after irradiation with a laser beam was performed and magnetic domain subdivision processing was performed (iron loss at a frequency of 50 Hz when a maximum magnetic flux density was 1.7 T or 1.9 T) was measured using a single sheet magnetic characteristic measurement method (a single sheet tester: SST) according to JIS C2556. Furthermore, the adhesion of the tension-insulation coating was evaluated in accordance with the following evaluation method. The obtained results are summarized in Table 1.

In Table 1, the column of a "peak position" in a "GDS/Si emission intensity" indicates whether the peak of the Si emission intensity existing on a portion closest to the base steel sheet side exists between a position of an inflection point in which a rate of increase of an Fe emission intensity in the sheet thickness direction from the surface of the grain-oriented electrical steel sheet changes and a saturation point in which the Fe emission intensity saturates. The score "A" indicates that the peak of the Si emission intensity existing on a portion closest to the base steel sheet side exists between the position of the inflection point and the saturation point and the score "B" indicates that the peak of the Si emission intensity existing on a portion closest to the base steel sheet side does not exist between the position of the inflection point and the saturation point.

Evaluation of Adhesion of Tension-Insulation Coating

The adhesion of the tension-insulation coating was evaluated as follows. First, a sample with width of 30 mm×length 300 mm was taken from each of the grain-oriented electrical steel sheets, subjected to strain removal and annealing in a nitrogen stream at 800° C. for 2 hours, subjected to a bending adhesion test using a cylindrical column of 10 mmφ, and subjected to evaluation in accordance with a degree of peeling of the tension-insulation coating. Evaluation criteria are as follows and the scores A and B were accepted.

Score A: no peeling
Score B: almost no peeling
Score C: a few mm of peeling is seen
Score D: ⅓ to ½ peeling is seen
Score E: full peeling

TABLE 1

| | First surface treatment process | | | Heating treatment process | | | | Second surface treatment process | | | Iron-based | GDS Si emission intensity | | | | High magnetic field iron loss (W/kg) | | |
|---|---|---|---|---|---|---|---|---|---|---|---|---|---|---|---|---|---|---|
| No | Acid | Liquid temperature (° C.) | Treatment time (second) | Atmosphere (% by volume) | Dew point (° C.) | Steel sheet temperature (° C.) | Treatment time (second) | Acid | Liquid temperature (° C.) | Treatment time (second) | oxide layer Thickness (nm) | Number of peaks | Peak position | Si ratio in steel | Adhe-sion | W17/50 | W19/50 | Remarks |
| 1 | 5% Sulfuric acid | 80 | 10 | 20% $O_2$ | 25 | 850 | 30 | 1% Sulfuric acid | 60 | 10 | 360 | 2 | A | 0.50 | B | 0.65 | 0.96 | Example |
| 2 | 2% Sulfuric acid | 85 | 10 | 20% $O_2$ | −18 | 800 | 40 | 5% Sulfuric acid | 70 | 5 | 200 | 2 | A | 0.36 | A | 0.66 | 0.99 | Example |
| 3 | 10% Sulfuric acid | 70 | 2 | 20% $O_2$ | 15 | 880 | 10 | 5% Sulfuric acid | 80 | 5 | 160 | 2 | A | 1.20 | A | 0.67 | 1.00 | Example |
| 4 | 5% Nitric acid | 70 | 10 | 20% $O_2$ | 28 | 750 | 55 | 1% Nitric acid | 55 | 3 | 180 | 2 | A | 0.70 | B | 0.63 | 1.04 | Example |
| 5 | 20% Phosphoric acid | 80 | 20 | 2% $O_2$ | −10 | 850 | 30 | 7% Phosphoric acid | 70 | 3 | 200 | 1 | A | 2.20 | B | 0.62 | 0.91 | Example |
| 6 | 25% Sulfuric acid | 60 | 10 | 20% $O_2$ | 15 | 850 | 30 | 5% Sulfuric acid | 60 | 10 | 180 | 2 | A | 0.21 | C | 0.66 | 1.01 | Comparative example |
| 7 | 0.5% Sulfuric acid | 80 | 60 | 20% $O_2$ | 15 | 850 | 30 | 1% Sulfuric acid | 80 | 60 | 80 | 0 | — | — | E | 0.68 | 1.07 | Comparative example |
| 8 | 10% Sulfuric acid | 60 | 10 | 20% $O_2$ | 15 | 850 | 30 | 5% Sulfuric acid | 60 | 10 | 410 | 0 | — | — | E | 0.71 | 1.08 | Comparative example |
| 9 | 5% Sulfuric acid | 95 | 10 | 20% $O_2$ | 15 | 850 | 30 | 5% Sulfuric acid | 95 | 10 | 80 | 2 | A | 0.26 | 0 | 0.67 | 1.15 | Comparative example |
| 10 | 10% Sulfuric acid | 75 | 10 | 20% $O_2$ | 20 | 600 | 30 | 5% Sulfuric acid | 75 | 10 | 40 | 0 | — | — | E | 0.72 | 1.09 | Comparative example |
| 11 | 15% Phosphoric acid | 75 | 10 | 20% $O_2$ | 20 | 1000 | 10 | 7% Phosphoric acid | 80 | 14 | 440 | 2 | A | 2.80 | C | 0.69 | 1.13 | Comparative example |
| 12 | 5% Sulfuric acid | 85 | 10 | 20% $O_2$ | 10 | 800 | 4 | 5% Sulfuric acid | 80 | 10 | 120 | 2 | A | 0.12 | E | 0.74 | 1.10 | Comparative example |
| 13 | 5% Sulfuric acid | 85 | 10 | 20% $O_2$ | −8 | 850 | 80 | 1% Sulfuric acid | 80 | 10 | 320 | 1 | A | 0.08 | D | 0.64 | 1.18 | Comparative example |
| 14 | 5% Sulfuric acid | 85 | 10 | 20% $O_2$ | 15 | 800 | 30 | 0.5% Sulfuric acid | 80 | 10 | 240 | 2 | A | 0.21 | 0 | 0.67 | 1.03 | Comparative example |

TABLE 1-continued

| | First surface treatment process | | | Heating treatment process | | | | Second surface treatment process | | | Iron-based | GDS Si emission intensity | | | | High magnetic field iron loss (W/kg) | | |
|---|---|---|---|---|---|---|---|---|---|---|---|---|---|---|---|---|---|---|
| No | Acid | Liquid temperature (° C.) | Treatment time (second) | Atmosphere (% by volume) | Dew point (° C.) | Steel sheet temperature (° C.) | Treatment time (second) | Acid | Liquid temperature (° C.) | Treatment time (second) | oxide layer Thickness (nm) | Number of peaks | Peak position | Si ratio in steel | Adhe-sion | W17/50 | W19/50 | Remarks |
| 15 | 5% Sulfuric acid | 85 | 15 | 20% $O_2$ | 25 | 750 | 30 | 15% Sulfuric acid | 80 | 10 | 60 | 0 | — | — | E | 0.65 | 1.12 | Comparative example |
| 16 | 5% Sulfuric acid | 85 | 15 | 2% $O_2$ | 25 | 850 | 30 | 5% Sulfuric acid | 80 | 0.5 | 160 | 2 | A | 0.22 | E | 0.63 | 1.08 | Comparative example |
| 17 | 5% Sulfuric acid | 85 | 15 | 20% $O_2$ | 20 | 850 | 15 | 5% Sulfuric acid | 80 | 12 | 120 | 0 | — | — | 0 | 0.63 | 0.99 | Comparative example |
| 18 | 5% Sulfuric acid | 80 | 10 | | No heating treatment | | | 1% Sulfuric acid | 60 | 10 | 100 | 1 | A | 0.25 | E | 0.72 | 1.21 | Comparative example |
| 19 | 5% Sulfuric acid | 80 | 10 | 20% $O_2$ | 15 | 850 | 15 | 7% Phosphoric acid | 80 | 5 | 200 | 2 | A | 0.6 | B | 0.64 | 0.97 | Example |

As a result of the analysis using the X-ray crystal structure analysis method described above, the iron-based oxide layers of the samples corresponding to the examples of the present invention contained magnetite, hematite, and fayalite as main components and the silicon-containing oxide layers contained silica and fayalite as main components. On the other hand, although the iron-based oxide layers contained magnetite, hematite, and fayalite as main components were formed in the comparative examples outside of the scope of the present invention, the silicon-containing oxide layers showing a prescribed number of peaks and prescribed peak heights were not formed.

Samples were prepared from the grain-oriented electrical steel sheets according to the examples and analyzed using a SEM-EDS. As a result, in the intermediate layers in the grain-oriented electrical steel sheets according to the examples, the Mg content in each case was 20 atom % or less and an inorganic coating containing forsterite as a main component was not formed.

As is clear from Table 1 above, it can be seen that the samples corresponding to the examples of the present invention have extremely excellent adhesion and the high magnetic field iron loss is improved. On the other hand, it can be seen that the samples corresponding to the comparative examples of the present invention are inferior in at least either adhesion or high magnetic field iron loss.

Although the preferred embodiments of the present invention have been described in detail above with reference to the accompanying drawings, the present invention is not limited to such examples. It is clear that a person having ordinary knowledge in the field of technology to which the present invention belongs can come up with various changed examples or modified examples within the scope of the technical ideas described in the claims and it is naturally understood that these also belong to the technical scope of the present invention.

REFERENCE SIGNS LIST

1 Grain-oriented electrical steel sheet
11 Base steel sheet
13 Tension-insulation coating
15 Iron-based oxide layer
17 Silicon-containing oxide layer
21 Microstructure (etch pit)

The invention claimed is:

1. A grain-oriented electrical steel sheet which does not have an inorganic coating containing forsterite as a main component, comprising:

a base steel sheet;

a silicon-containing oxide layer provided on the base steel sheet;

an iron-based oxide layer provided on the silicon-containing oxide layer; and a tension-insulation coating provided on the iron-based oxide layer, having a thickness of 1 to 3 μm, and containing phosphate and colloidal silica as main components, wherein the base steel sheet contains, in terms of mass %, 2.5 to 4.5% of Si, 0.05 to 1.00% of Mn, 0% or more and less than 0.05% of Al, 0% or more and less than 0.1% of C, 0% or more and less than 0.05% of N, 0% or more and less than 0.1% of S, 0% or more and less than 0.05% of Se, 0% or more and less than 0.01% of Bi, and the remainder: Fe and impurities as chemical components, and when the tension-insulation coating undergoes elemental analysis using a glow discharge optical emission spectrometry in a sheet thickness direction from a surface of the tension- insulation coating, (a) there are two or more peaks of a Si emission intensity;

(b) a peak A which is a peak of the Si emission intensity existing furthest to the base steel sheet side in the sheet thickness direction exists between an inflection point at which a rate of increase in an Fe emission intensity in the sheet thickness direction from the surface of the tension-insulation coating changes and a saturation point at which the Fe emission intensity become saturated; and (c) when a length of a perpendicular line when a perpendicular line is drawn from the top portion of a peak to a baseline connecting valley portions closest to the peak is defined as a peak height, a peak height of the peak A is 0.30 times or more and 2.5 times or less the Si emission intensity in the base steel sheet.

2. The grain-oriented electrical steel sheet according to claim 1, wherein the silicon-containing oxide layer contains silica and fayalite as main components, and the tension-insulation coating contains 25 to 45 mass % of colloidal silica and the remainder is one or more of aluminum phosphate, magnesium phosphate, zinc phosphate, manganese phosphate, cobalt phosphate, and iron phosphate.

3. The grain-oriented electrical steel sheet according to claim 2, wherein the iron-based oxide layer contains magnetite, hematite, and fayalite as main components.

4. The grain-oriented electrical steel sheet according to claim 2, wherein a thickness of the base steel sheet is 0.27 mm or less.

5. The grain-oriented electrical steel sheet according to claim 1, wherein the iron-based oxide layer contains magnetite, hematite, and fayalite as main components.

6. The grain-oriented electrical steel sheet according to claim 5, wherein a thickness of the base steel sheet is 0.27 mm or less.

7. The grain-oriented electrical steel sheet according to claim 1, wherein a thickness of the base steel sheet is 0.27 mm or less.

8. A method for manufacturing a grain-oriented electrical steel sheet which includes a base steel sheet and a tension-insulation coating and does not have an inorganic coating containing forsterite as a main component, comprising:

a washing process of cleaning a surface of the grain-oriented electrical steel sheet;

a first surface treatment process of treating the surface of the grain-oriented electrical steel sheet which has been subjected to the washing process using a first treatment liquid which contains one or more of sulfuric acid, phosphoric acid, and nitric acid and having a total acid concentration of 2 to 20% and a liquid temperature of 70 to 90° C.;

a heating treatment process of heating the grain-oriented electrical steel sheet which has been subjected to the first surface treatment process at a temperature of 700 to 900° C. for 10 to 60 seconds in an atmosphere having an oxygen concentration of 1 to 21% by volume and a dew point of −20 to 30° C.;

a second surface treatment process of treating the surface of the grain-oriented electrical steel sheet which has been subjected to the heating treatment process for 1 to 10 seconds using a second treatment liquid which contains one or more of sulfuric acid, phosphoric acid, and nitric acid and having a total acid concentration of 1 to 10%; and a tension-insulation coating forming process of forming a tension-insulation coating which has a thickness of 1 to 3 μm and contains phosphate and colloidal silica as main components on the surface of the grain-oriented electrical steel sheet which has been subjected to the second surface treatment process.

9. The method for manufacturing a grain-oriented electrical steel sheet according to claim 8, further comprising: before the washing process, a hot rolling process of subjecting a steel piece which contains, in terms of mass %, 2.5 to 4.5% of Si, 0.05 to 1.00% of Mn, less than 0.05% of Al, less than 0.1% of C, less than 0.05% of N, less than 0.1% of S, less than 0.05% of Se, less than 0.01% of Bi, and the remainder: Fe and impurities as chemical components to hot rolling;

an optional annealing process;

a cold rolling process of performing one cold rolling or two or more cold rollings having intermediate annealing performed between the cold rollings;

a decarburization annealing process; and a final annealing process of applying an annealing separator obtained by incorporating bismuth chloride into a mixture of MgO and $Al_2O_3$ or an annealing separator obtained by incorporating a bismuth compound and a metallic chlorine compound into a mixture of MgO and $Al_2O_3$, drying the annealing separator, and then performing final annealing.

* * * * *